US009377010B1

(12) United States Patent
Madgwick

(10) Patent No.: US 9,377,010 B1
(45) Date of Patent: Jun. 28, 2016

(54) HYDRAULIC PUMP JACK SYSTEM FOR OIL AND GAS WELLS

(71) Applicant: Kenneth B. Madgwick, Garden City, KS (US)

(72) Inventor: Kenneth B. Madgwick, Garden City, KS (US)

( * ) Notice: Subject to any disclaimer, the term of this patent is extended or adjusted under 35 U.S.C. 154(b) by 858 days.

(21) Appl. No.: 13/726,057

(22) Filed: Dec. 22, 2012

(51) Int. Cl.
*F04B 47/08* (2006.01)
*F04B 7/00* (2006.01)

(52) U.S. Cl.
CPC ..... *F04B 7/00* (2013.01)

(58) Field of Classification Search
CPC ..... F04B 7/00; F04B 47/00; F04B 47/08; E21B 43/129; E21B 43/126
See application file for complete search history.

(56) References Cited

U.S. PATENT DOCUMENTS 4,871,302 A * 10/1989 Clardy ..... F01L 25/063 417/404
5,069,602 A * 12/1991 Gipson ..... F04B 47/08 417/383
5,481,873 A * 1/1996 Saruwatari ..... F04B 47/04 60/421
6,966,366 B2 * 11/2005 Rogers, Jr. ..... E21B 43/129 166/102
7,490,674 B2 2/2009 Brecheisen
7,600,563 B2 10/2009 Brecheisen
2008/0000632 A1 * 1/2008 Brecheisen ..... E21B 43/126 166/72

* cited by examiner

*Primary Examiner* — Nathaniel Wiehe
*Assistant Examiner* — Abiy Teka
(74) *Attorney, Agent, or Firm* — Miller Law Group, PLLC

(57) ABSTRACT

A hydraulic pump jack cylinder is coupled with a closed loop hydraulic circuit, which includes a hydrostatic pump that delivers hydraulic fluid under pressure to the pump jack cylinder. The pump jack cylinder includes an inner extension piston area and an outer retraction piston area which are configured to have substantially the same area to establish a cylinder ration at 1:1. The hydrostatic pump drives the cylinder rod connected to the oil well sucker rod at a constant velocity in both the extension and retraction strokes with a quick sinusoidal turn-around at the ends of the strokes to provide a change in stroke direction. The swash plate in the hydrostatic pump brake the flow of fluid from the pump jack cylinder during retraction to prevent free-fall. A programmable logic controller controls the swash plate angles to switch stroke direction before the cylinder rod bottoms out.

17 Claims, 7 Drawing Sheets

HYDRAULIC PUMP JACK SYSTEM FOR OIL AND GAS WELLS

FIELD OF THE INVENTION

The invention disclosed in this application is directed generally to downhole pumping systems and, more particularly, to a hydraulic cylinder and operating system for powering the movement of a sucker rod pump mechanism for oil and gas from subsurface formations.

BACKGROUND OF THE INVENTION

Pumping devices have been developed over the years for extracting oil and gas from wells drilled into subsurface formations. One commonly utilized apparatus is a walking beam pump that includes a sucker rod extending into the ground for thousands of feet and being connected to the walking beam. The walking beam typically driven by an electric motor coupled to the opposite end of the walking beam by a pitman arm to induce a rocking motion into the walking beam to draw oil and/or gas out of the well. The walking beam apparatus has well known and well documented disadvantages and alternative drive mechanisms to move the sucker rod have been developed, such as a pump jack which is low profile and can be mounted above or below ground level together with an adjustable length stroke and extremely low power requirements.

One such alternative drive mechanism is a dual cylinder lift pump as disclosed in U.S. Pat. No. 7,490,674, granted to Marion Brecheisen on Feb. 17, 2009. The pair of hydraulic cylinders driving the movement of the sucker rod in U.S. Pat. No. 7,490,674 had a significant problem in the turn-around phase in changing the direction of movement of the cylinder rod, which in turn changes the direction of movement of the sucker rod. The switching of the open loop spool valve controlling the direction of movement of the hydraulic cylinder results in an abrupt switching of direction, which in turn causes substantial shock, rod stress and rod stretch. With sucker rods extending 5000 to 6000 feet into ground, the sucker rod mechanism can weigh 8000 pounds, which provides a significant resistance to an abrupt change in direction at the hydraulic cylinder driving mechanism.

A continuation-in-part solution to the above-identified problems was disclosed in U.S. Pat. No. 7,600,563, issued to Marion Brecheisen on Oct. 13, 2009, wherein a delay or hesitation cylinder was incorporated into the drive apparatus to resolve this problem, but from a practical application failed to increase reliability and durability.

Another problem associated with an abrupt change in direction for the hydraulic cylinder drive mechanism of an oil well sucker rod, particularly at the top of the stroke of the cylinder rod, is that the hydraulic cylinder tends to "free fall" until the flow of hydraulic fluid from the hydraulic pump can catch up with the movement of the piston. This "free-fall" in practice has been observed to extend for a drop of 12 to 16 inches before stabilizing. This "free-fall" problem is believed to be the result of the use of a spool valve to control the direction of movement of hydraulic fluid through the hydraulic cylinder, as the forces associated with the dropping of the heavy sucker rod cause a faster flow of hydraulic fluid from the cylinder into the reservoir tank faster than the hydraulic pump can fill the opposite side of the piston with hydraulic fluid from the reservoir.

The hydraulic drive mechanism disclosed in the aforementioned Brecheisen patents included a flow control in an attempt to control the speed of operation of the hydraulic cylinders. While the flow control did work, a flow control generates heat, which in a continuous operation like a pump jack drive mechanism results in oil temperatures getting too high. The limit switches in this disclosed drive mechanism were somewhat unreliable, especially in inclement winter weather conditions. The Brecheisen hydraulic cylinder configuration included a hydraulic delivery pipe attached to an external port and extending to the internal fluid passage to deliver hydraulic fluid thereto. Fabrication required extremely close tolerance and sometimes leaked. Ultimately the fitting for the external port had to be a custom made part.

Since these hydraulic pump jack cylinders are long and slender by nature, and are usually transported in a horizontal orientation, these hydraulic pump jack cylinders suffered seal problems. The looseness of the internal hydraulic delivery tube and the seal problems may be attributed to the assembly bouncing internally during transportation. The Brecheisen hydraulic cylinder interior stationary tube is attached only to the alignment ring, which must hold up roughly 10 feet of heavy wall steel tubing, plus the piston assembly, the heavy cylinder head and the inner piston tube.

It would be desirable to provide a hydraulic pump jack cylinder and associated drive mechanism for operating the sucker rod of an oil well that would resolve the aforementioned problems associated with the known pump jack cylinders and provide a sucker rod drive mechanism that would have greater durability and reliability.

SUMMARY OF THE INVENTION

It is an object of this invention to overcome the aforementioned disadvantages of the prior art by providing a hydraulic pump jack cylinder and associated hydraulic system for use to drive the operation of a sucker rod on an oil well to pump oil and gas from the underground formation.

It is another object of this invention to provide a hydraulic pump jack cylinder that is operable with a closed loop hydraulic system to power the operation of an oil well sucker rod.

It is still another object of this invention to utilize a closed loop hydraulic system to power the reciprocal movements of a hydraulic pump jack cylinder.

It is a feature of this invention that the hydraulic pump jack cylinder has a cylinder ratio of 1:1.

It is another feature of this invention that the hydraulic pump jack cylinder is configured as a dual cylinder having an inner piston area for extending the cylinder rod and an outer piston area for retracting the cylinder rod.

It is an advantage of this invention that the inner piston area and the outer piston area are substantially equal in size to provide a 1:1 cylinder ratio.

It is still another object of this invention to couple the hydraulic pump jack cylinder to a closed loop hydraulic circuit.

It is still another feature of this invention that the closed loop hydraulic circuit includes a hydrostatic pump powering the operation of the hydraulic pump jack cylinder for extension and retraction of the cylinder rod.

It is another advantage of this invention that most of the stroke of the hydraulic pump jack cylinder in either extension or retraction is accomplished at a constant velocity.

It is still another advantage of this invention that the ends of both the extension and retraction strokes of the hydraulic pump jack cylinder change direction in a quick sinusoidal turn-around operation.

It is yet another feature of this invention that the changing of the swash plate angle in the hydrostatic pump to reverse direction of fluid flow provides the quick sinusoidal turn-around for the change of stroke direction in the hydraulic pump jack cylinder.

It is a further feature of this invention that the swash plate in the hydrostatic pump brake the oil flow from the hydraulic pump jack cylinder during retraction.

It is yet another advantage of this invention that the hydraulic pump jack cylinder does not suffer from free-fall at the beginning of the retraction stroke due to the forces applied to the cylinder rod from the sucker rod structure.

It is a further advantage of this invention that the operation of the sucker rod drive mechanism utilizing the principles of the instant invention will not establish a resonance in the sucker rod structure due to the constant velocity stroke and the quick sinusoidal turn-around for change of stroke direction.

It is yet another object of this invention to couple a hydraulic pump jack cylinder with a closed circuit hydraulic circuit to power the extension and contraction of the hydraulic pump jack cylinder to perform work therewith.

It is a further object of this invention to control the operation of a closed loop hydraulic circuit powering the extension and contraction of a hydraulic pump jack cylinder with a programmable logic controller.

It is another advantage of this invention that the programmable logic controller is operable to stop the stroke of the cylinder rod before reaching the absolute end of the stroke, whether extension or retraction.

It is still another feature of this invention that monitoring the charge pressure in the closed loop hydraulic circuit enables an early detection of a significant leak in the hydraulic system.

It is still another advantage of this invention that the early detection of a significant leak in the hydraulic system prevents a significant amount of hydraulic fluid to be discharged from the hydraulic system.

It is yet another feature of this invention that the internal working cylinders of the hydraulic pump jack cylinder are centered on an internal centering device to maintain the centered position of the working cylinder head under all conditions.

It is yet another advantage of this invention that durability and reliability of the hydraulic pump jack cylinder and drive system are substantially increased over the known prior art sucker rod drive mechanisms.

It is a further advantage of this invention that the seals of the hydraulic pump jack cylinder can be changed relatively quickly as compared to known prior art sucker rod drive mechanisms.

It is a further object of this invention to provide a hydraulic pump jack cylinder and closed loop hydraulic circuit to power the operation of an oil well sucker rod, which is durable in construction, inexpensive of manufacture, carefree of maintenance, facile in assemblage, and simple and effective in use.

These and other objects, features and advantages are accomplished according to the instant invention by providing a hydraulic pump jack cylinder coupled to a closed loop hydraulic circuit which includes a hydrostatic pump that delivers hydraulic fluid under pressure to the pump jack cylinder. The pump jack cylinder includes an inner extension piston area and an outer retraction piston area which are configured to have substantially the same area to establish a cylinder ration at 1:1. The hydrostatic pump drives the cylinder rod connected to the oil well sucker rod at a constant velocity in both the extension and retraction strokes with a quick sinusoidal turn-around at the ends of the strokes to provide a change in stroke direction. The swash plate in the hydrostatic pump brake the flow of fluid from the pump jack cylinder during retraction to prevent free-fall. A programmable logic controller controls the swash plate angles to switch stroke direction before the cylinder rod bottoms out.

BRIEF DESCRIPTION OF THE DRAWINGS

The advantages of this invention will become apparent upon consideration of the following detailed disclosure of the invention, especially when taken in conjunction with the accompanying drawings wherein.

DETAILED DESCRIPTION OF THE PREFERRED EMBODIMENT

Figure 1:
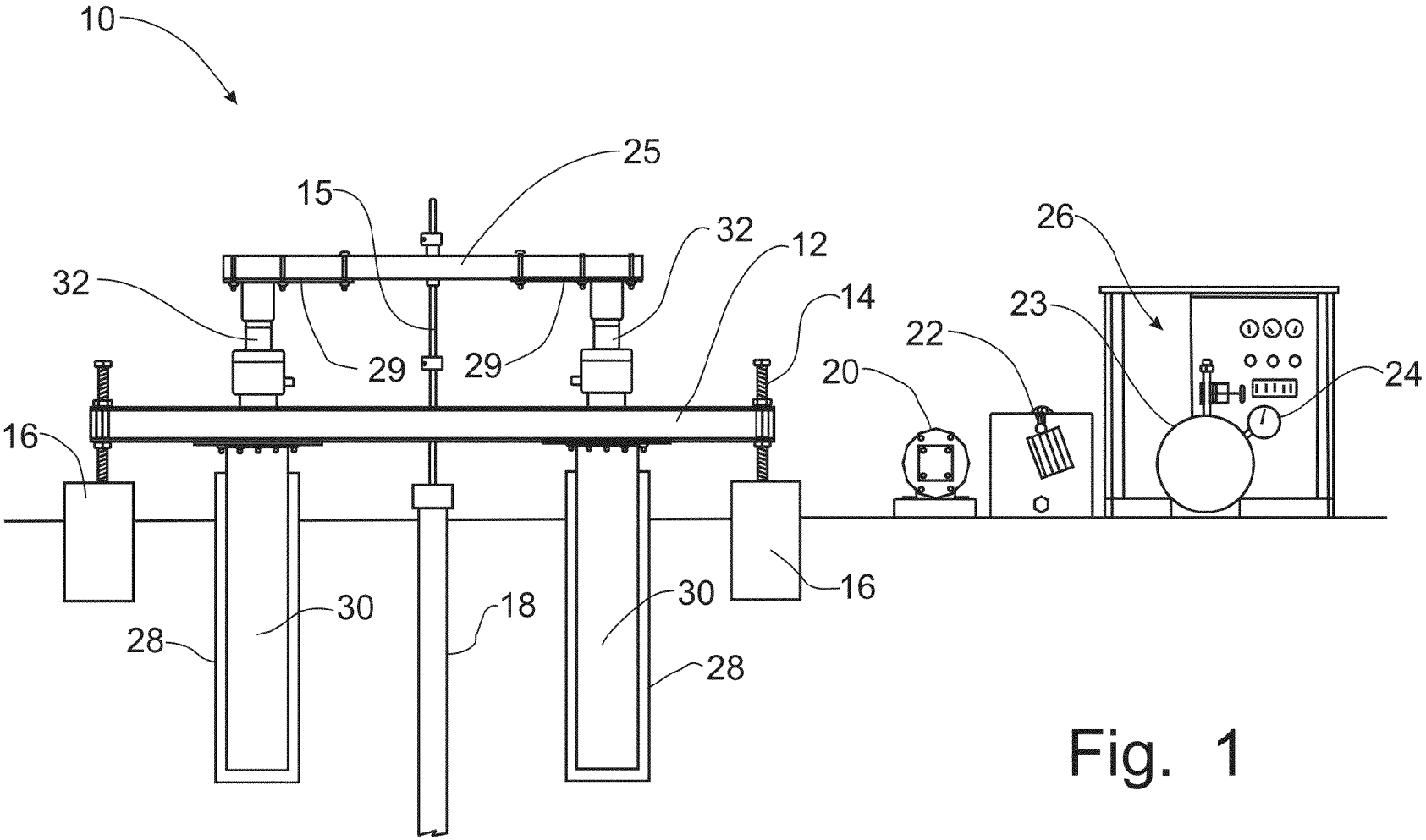
FIG. 1 is a schematic view of a pump jack system for operating a sucker rod string to extract oil and/or gas from a subsurface formation.
Figure 2:
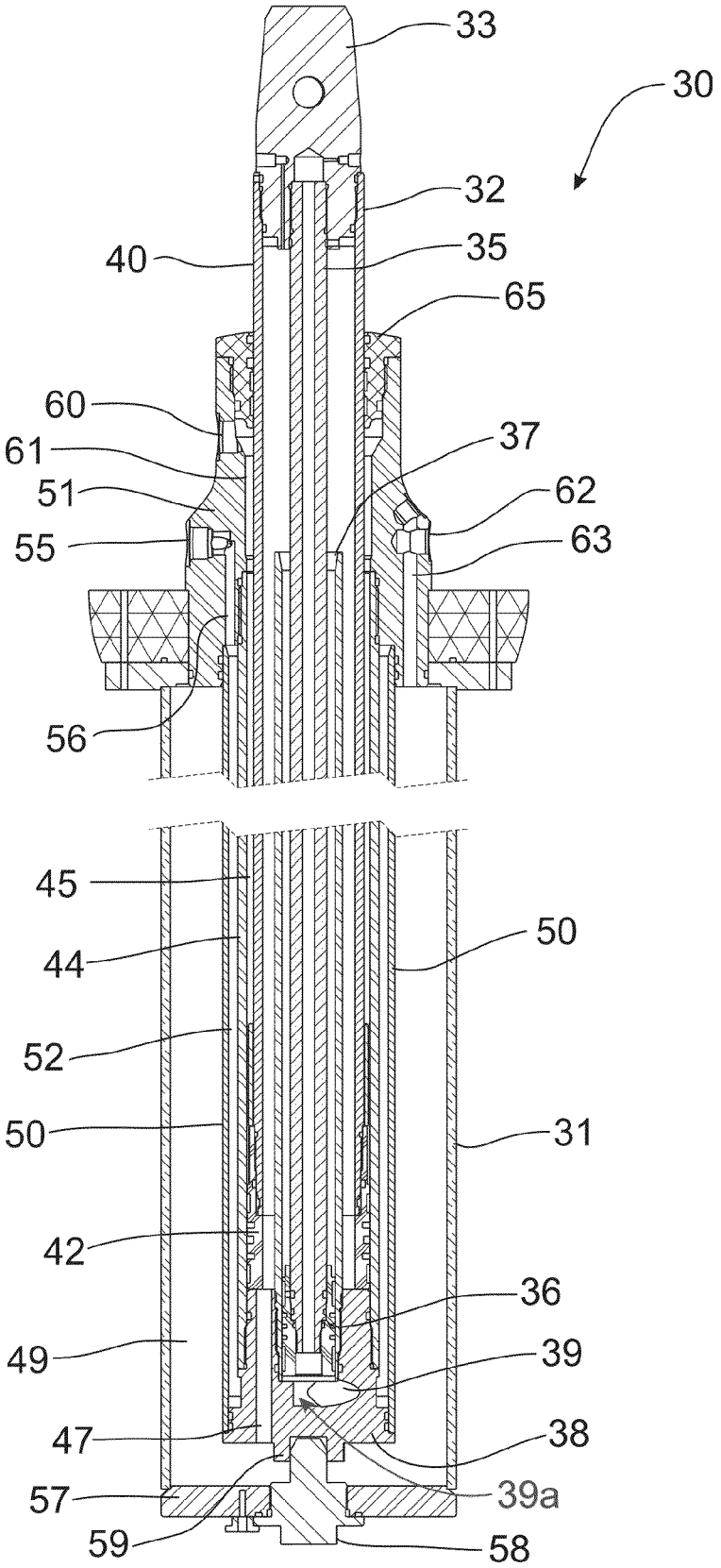
FIG. 2 is a cross-sectional view of the hydraulic pump jack cylinder in the retracted position.
Figure 3:
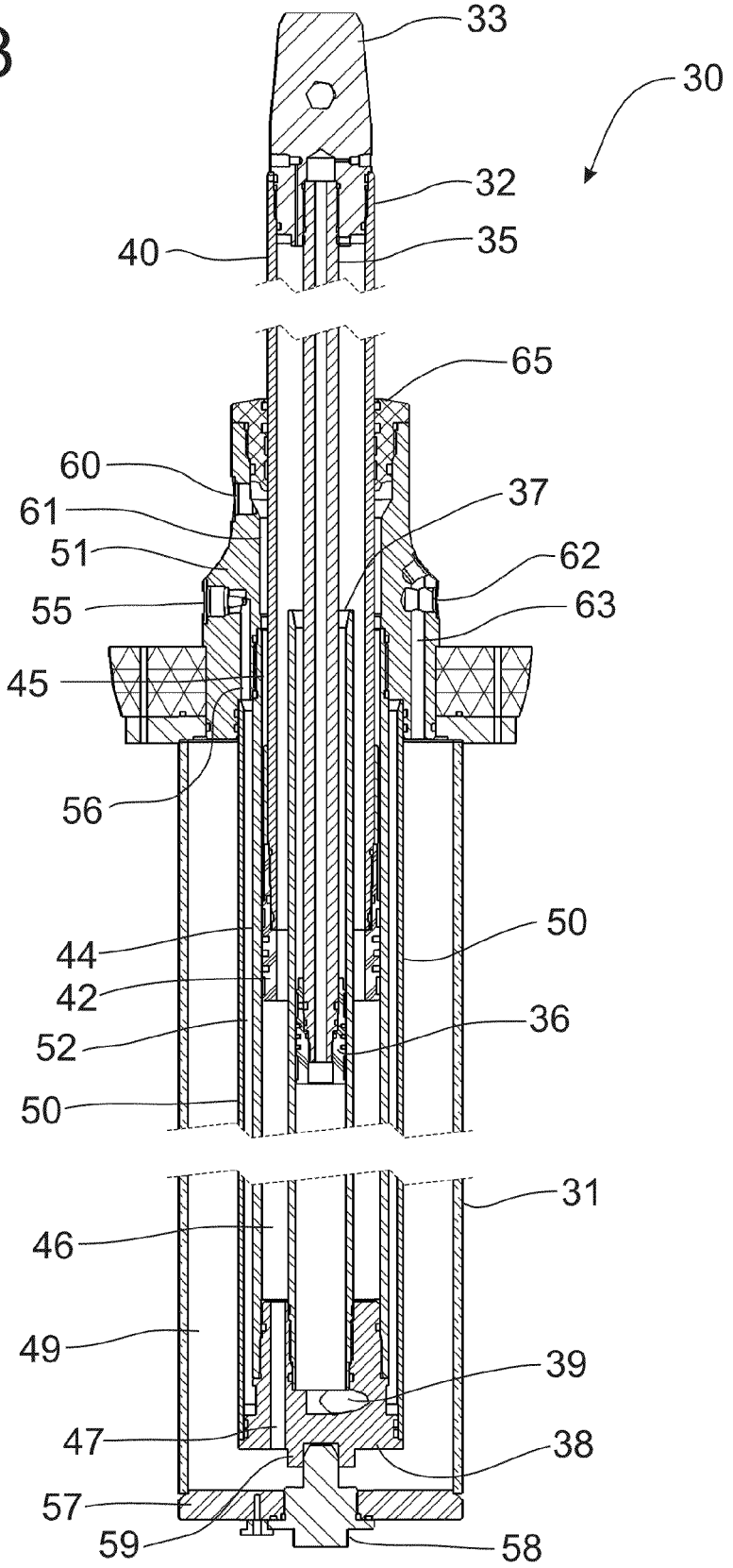
FIG. 3 is a cross-sectional view of the hydraulic pump jack cylinder shown in FIG. 2, but in the extended position.
Figure 5:
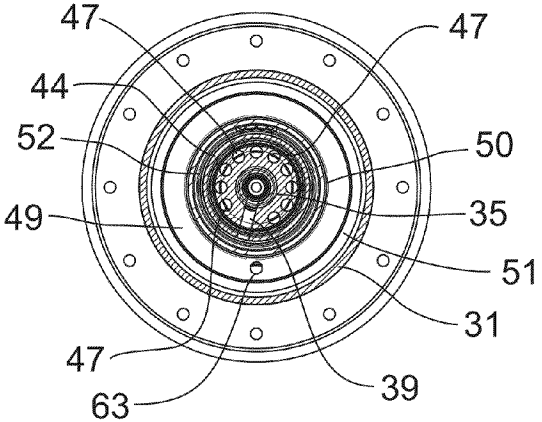
FIG. 5 is an enlarged cross-sectional view of the cylinder base cap corresponding to lines 5-5 of FIG. 4 to show the holes passing through the cylinder base cap.
Figure 4:
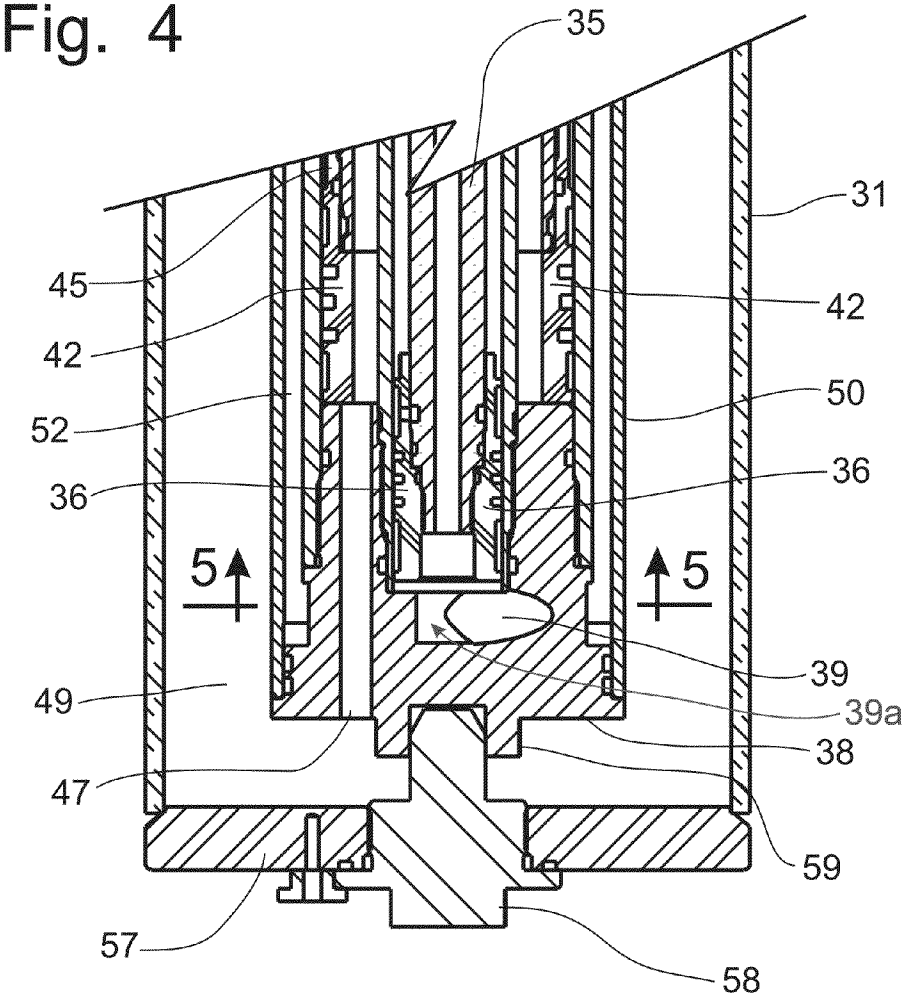
FIG. 4 is an enlarged cross-sectional view corresponding to the lower end of the hydraulic pump jack cylinder.

Referring to FIG. 1, an exemplary pump jack system 10, incorporating the principles of the instant invention, for the extraction of oil and gas from subsurface formations can best be seen. The pump jack system 10 includes a base frame or platform 12 adjustably mounted by leveling screws 14 in concrete footings 16. A conventional pump rod 15, also known as a sucker rod, extends downwardly through an existing well casing 18 and is flanked on opposite sides by cylinder assemblies 30. Each cylinder assembly 30 has a piston rod 32 mounted at its upper end to a cross bar 25 to affect movement thereof, as will be described in greater detail below. Each cylinder assembly 30 is connected to and powered by a hydraulic circuit, which is also described in greater detail below. A suitable control panel 26 regulates the supply of hydraulic fluid to the cylinder assemblies 30 to control the lifting and lowering of the pump rod 15 via the vertical movement of the cross bar 25 induced by the extension and retraction of the cylinder assemblies 30.

The pump rod 15 is of conventional construction having a string of rods extending through the well casing and with a downhole pump having a reciprocal plunger which will force the fluid upwardly through the casing on alternate strokes of the pump rod string. The pump rod string may extend downwardly for considerable distances running anywhere from a few hundred feet to several thousand feet deep. Accordingly, on each lift stroke of the pump rod string the cylinder assemblies 30 must be capable of overcoming not only the weight of the pump rod assembly and its downhole accessories, but also the weight of the fluid being lifted to the surface and other inertial and frictional forces as well. Moreover, when the pump rod 15 is reversed to complete each cycle, the cylinders 30 will be forced to overcome equal if not greater loads on each downstroke of the pump rod 15.

More detailed information relating to the pump jack system 10 can be found in U.S. Pat. No. 7,490,674, issued to Marion Brecheisen on Feb. 17, 2009, the content of which is incorporated herein by reference. The platform or base frame 12 is made up of spaced parallel I-beams interconnected by spaced parallel, transverse braces with a concrete footing 16 at each of the four corners. The leveling screws 14 can be utilized to level the base frame 12 to compensate for slopes or differences in terrain. It will be readily apparent that the base frame 12 may be modified for off-shore platform operations. Equally as important, the base frame 12 is installed with respect to an existing pump rod 15 and its casing 18, and in ground operations the necessary bores are drilled into the ground for insertion of the cylinders 30 into cylinder casing protectors 28.

Another feature of the embodiment described is the ability to utilize in fields where other above-ground operations are being carried on, such as, automatic irrigation systems having walking beams which traverse extremely large areas of the field and where the irrigation lines are typically raised to no more than 8' to 10' above the ground. In order to permit continuous operation of the pump jack systems it is important to be able to limit the length of stroke of the pump jack and cylinders 30 above the ground surface so as not to interfere with advancement of the irrigation lines while maintaining a substantially constant recovery of the subsurface fluids, such as, oil, gas or water. The upper cross bar 25 is preferably in the form of a hollow, generally rectangular beam to which the upper ends of the piston rods 32 are attached by connecting plates 29. The connecting plates 29 are preferably taper locked to the upper ends of the piston rods 32, and adjustably attached to the underside of the cross bar 25 by spaced U-bolts or connecting straps.

Figure 7:
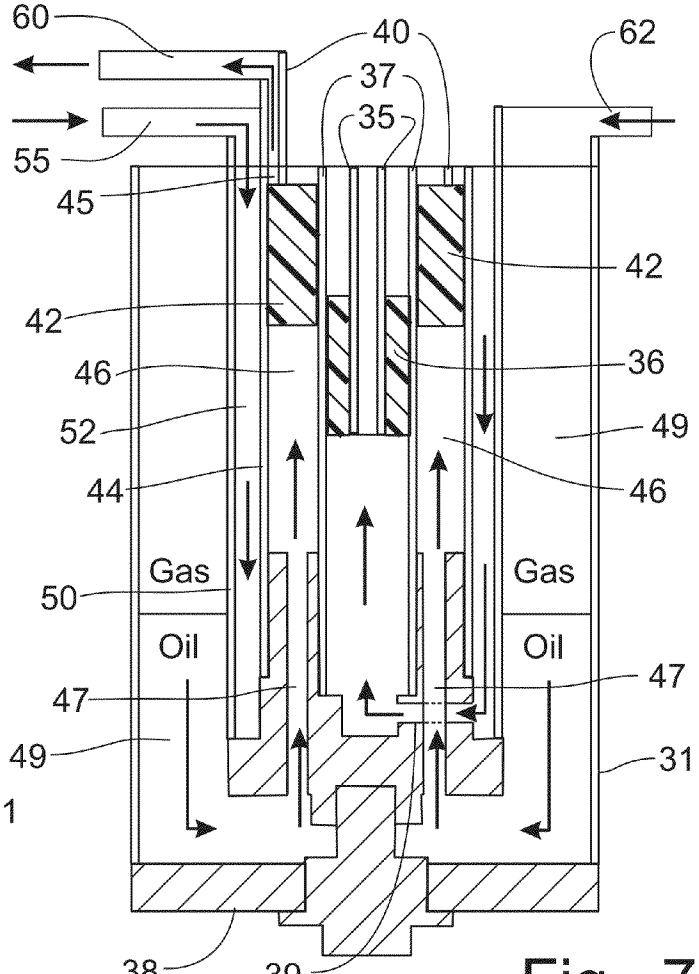
FIG. 7 is a diagrammatic cross-sectional view of the hydraulic pump jack cylinder as depicted in FIG. 3, in an extended position, showing the flow of fluid within the hydraulic pump jack cylinder during the extension of the piston rod.
Figure 6:
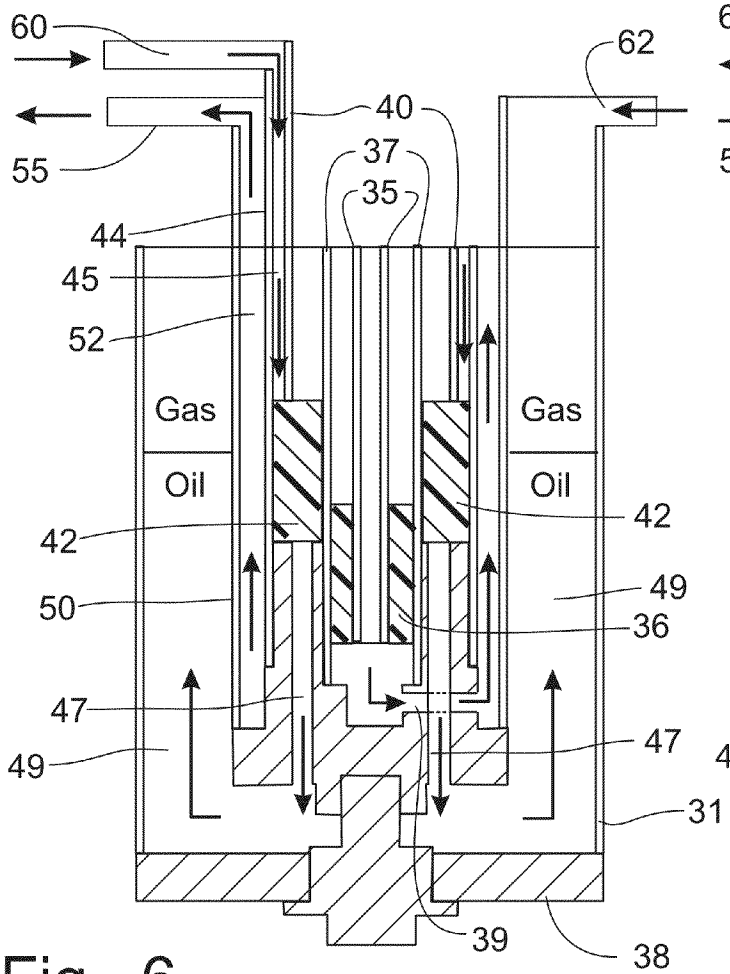
FIG. 6 is a diagrammatic cross-sectional view of the hydraulic pump jack cylinder as depicted in FIG. 2, in the retracted position, showing the flow of fluid within the hydraulic pump jack cylinder during the retraction of the piston rod.

The hydraulic pump jack cylinder 30, incorporating the principles of the instant invention, is best seen in cross-section in FIGS. 2-7. Corresponding simplified diagrammatic sectional views of the hydraulic pump jack cylinder 30 are depicted in FIGS. 6 and 7 to aid in the understanding of the operation of the pump jack cylinder 30. Similar to the pump jack cylinder shown and described in the aforementioned Brecheisen patents, the pump jack cylinder 30 is a dual hydraulic cylinder having a chromed piston rod 32 that extends and retracts from the fixed cylinder casing 31 in a manner described in greater detail below to cause a corresponding vertical movement of the cross bar 25 and the attached sucker rod 15. The piston rod 32 terminates in a solid head 33 that is adapted to be received within the cross bar 25, and captured by the corresponding connecting plate 29.

The piston rod 32 is formed with an inner piston shaft 35 that is secured to the head 33, such as by threading into the head 33. The inner piston shaft 35 is slidably received within an inner, small diameter, piston tube 37 and carries dynamic seals 36 at a lower end thereof to seal against the interior surface of the first piston tube 37. The inner piston tube 37 is fixed into the cylinder base cap 38 to permit the inner piston shaft 35 to move vertically relative to the inner piston tube 37. The cylinder base cap 38 is formed with a central pocket **39*a* located beneath the inner piston shaft 35 to permit the introduction of hydraulic fluid under pressure through a cross hole 39 in flow communication with the first fluid flow path 52** as will be described in greater detail below.

As hydraulic fluid is introduced through the cross hole 39 into the pocket **39*a* beneath the inner piston shaft 35, the seals 36 prevent the hydraulic fluid from passing and the inner piston shaft 35 extends vertically relative to the inner piston tube 37 to push the piston head 33 upwardly relative to the cylinder base casing 31. The inner piston tube 37 terminates internally within the chromed piston rod 32 at a location spaced below the piston head 33, but the inner piston shaft 35 terminates the extension thereof relative to the inner piston tube 37 before disengaging the inner piston tube 37. The positional control of the inner piston shaft 35 relative to the inner piston tube 37 is operatively controlled by the control mechanism 26**, as will be described in greater detail below.

The chromed piston rod 32 also includes an outer piston shaft 40 concentric with the inner piston shaft 35. Both the inner and outer piston shafts 35, 40 are connected to the piston head 33 and are movable therewith. Thus, as the inner piston shaft 35 extends relative to the inner piston tube 37 to drive the piston head vertically relative to the cylinder base casing 31, the outer piston shaft 40 extends with the piston head 33. The outer piston shaft 40 is fitted with dynamic seals 42 at the lower end thereof to seal against the interior surface of the outer piston tube 44. Therefore, as the inner piston shaft 35 extends, the outer piston shaft 40 also extends relative to the outer piston tube 44, which is also secured to the cylinder base cap 38.

Retraction of the piston rod 32 is accomplished by the introduction of hydraulic fluid under pressure into the cavity 45 between the outer piston shaft 40 and the outer piston tube 44. Since the seals 42 prevent the hydraulic fluid from passing by the seals 42, the lower end of the outer piston shaft 40 is moved toward the cylinder base cap 38 drawing the piston head 33 downwardly into the cylinder base casing 31. This retraction of the piston outer shaft 40, by virtue of the connection of the outer piston shaft 40 to the piston head 33, also drives the inner piston shaft 35 into the inner piston tube 37, pushing the hydraulic fluid collected beneath the inner piston shaft 35 outwardly through the cross hole 39.

The vertical extension movement of the outer piston shaft 40 leaves a void 46 beneath the seals 42 above the cylinder base cap 38 and between the exterior surface of the inner piston tube 37 and the interior surface of the outer piston tube 44. To prevent the formation of a vacuum within this void 46 by the extension of the outer piston shaft 40, the cylinder base cap 38 is formed with a series of holes 47 in alignment with the void 46 passing through the cylinder base cap 38 around the circumference of the cylinder base cap 38. As can be seen in FIGS. 2-5, the cylinder base casing 31 is substantially larger than the working cylinder components, thus forming a cavity 49 surrounding the working cylinder components. This cavity 49 includes a pre-determined quantity of hydraulic fluid that is movable through the holes 47 into the growing void 46 as the piston head 33 extends vertically, and outwardly through the holes 47 into the cavity 49 when the piston head 33 retracts. To pressurize the hydraulic fluid within the cavity 49, a supply of an inert gas, such as nitrogen, can be supplied to the cavity 49 under pressure, as will be described in greater detail below.

According to the principles of the instant invention, the cross-sectional area of the cavity 45 above the seals 42 is equal to the cross-sectional area of the end of the inner piston shaft 35 at the pocket. This configuration of this pump jack cylinder 30 with the cross-sectional area against which hydraulic fluid applies force for extension of the piston head 33 equal to the cross-sectional area of against which hydraulic fluid applies force to retract the piston head 33 creates a hydraulic cylinder 30 with a 1:1 cylinder ratio. Therefore, the volume of fluid displaced during extension and retraction, respectively, is equal.

The working components of the pump jack cylinder 30 are operable within a cylinder housing 50 surrounding the outer piston tube 44 and being spaced radially therefrom defining an annular fluid passageway 52 between the interior surface of the outer cylinder housing 50 and the exterior surface of the outer piston tube 44. the cylinder base cap 38 is secured and sealed into the lower end of the cylinder housing 50. A port 55 is formed in the cylinder end cap 51 and is in flow communication with an access passageway 56 that is, in turn, in flow communication with the annular fluid passageway 52, which extends from the upper cylinder end cap 51 to the lower cylinder base cap 38. The cross hole 39 intersects the fluid passageway 52 and the pocket beneath the inner piston shaft 35 to deliver a flow of hydraulic fluid under pressure from the port 55 to the bottom end of the inner piston shaft 35. The static seals between the cylinder housing 50 and the cylinder base cap 38, as well as the static seals between the cylinder housing 50 and the cylinder end cap 51, maintain the integrity of the fluid passageway 52.

The cylinder casing 31 is mounted on and sealed against an end plug 57 having a central bore therethrough. A centering pin 58 is mounted on and sealed against the cylinder end plug 57 through the central bore. The centering pin 58 projects into the cavity 49 to be received into a receiving cup 59 formed into the bottom surface of the cylinder base cap 38. Thus, the entire working components of the pump jack cylinder 30 are stabilized to keep the cylinder base cap 38 centered within the cylinder casing 31 under all circumstances. The inner and outer piston shafts 35, 40 are associated with linear transducers (not shown), rather than exterior limit switches, to monitor the extension and retraction of the inner an outer piston shafts 35, 40 relative to the corresponding inner and outer piston tubes 37, 44 and provide input to the control mechanism 26, as will be described in greater detail below.

Hydraulic fluid under pressure can be introduced into the cavity 45 above the seals 42 through the port 60 which is in flow communication through the access passageway 61, which in turn is in flow communication with the cavity 45. Thus, hydraulic fluid in introduced into the cavity 45 through the port 60 to retract the piston head 33, during which retraction hydraulic fluid is extracted from beneath the inner piston shaft 35 through the cross hole 39 and into the fluid passageway 52 and out through the port 55. Conversely, hydraulic fluid under pressure introduced through the port 55 into the fluid passageway 52 and through the cross hole 39 cause the inner piston shaft 35 and the connected piston head 33 to extend, while hydraulic fluid is extracted from the cavity 45 through the port 60 as the seals 42 move upwardly through the cavity 45. The application of an inert gas, such as nitrogen, under pressure into the cylinder casing cavity 49 through the port 62 and associated access passageway 63 pushes the hydraulic fluid within the casing cavity 49 through the holes 47 in the cylinder base cap 38 and into the void 46 as the seals 42 move upwardly through the cavity 45.

The pump jack cylinder 30 is configured with the lower end of the inner piston shaft 35 extending below the lower end of the outer piston shaft 40, which provides an improved access to the seals 36, 42 for servicing the cylinder 30. When the seals 36, 42 are worn and require replacement, the cross bar 35 is disconnected from the pump jack cylinders 30, such as by removing the connecting plates 29 and disengaging the piston head 33 from the cross bar 25. The gland 65 is unfastened from the cylinder end cap 51 to allow the chromed rod 32 to be lifted out of the cylinder housing 50 through the cylinder end cap 51. Since the inner and outer piston shafts 35, 40 are attached to the piston head 33, the inner and outer shafts 35, 40, as well as the seals 36, 42 mounted thereon, are removed from the cylinder housing 50. With the inner piston shaft 35 projecting away from the outer piston shaft 40, removal and replacement of the respective seals 36, 42 is easily accomplished and the inner and outer piston shafts 35, 40 returned to their proper engagement with the inner and outer piston tubes 37, 44.

Figure 8:
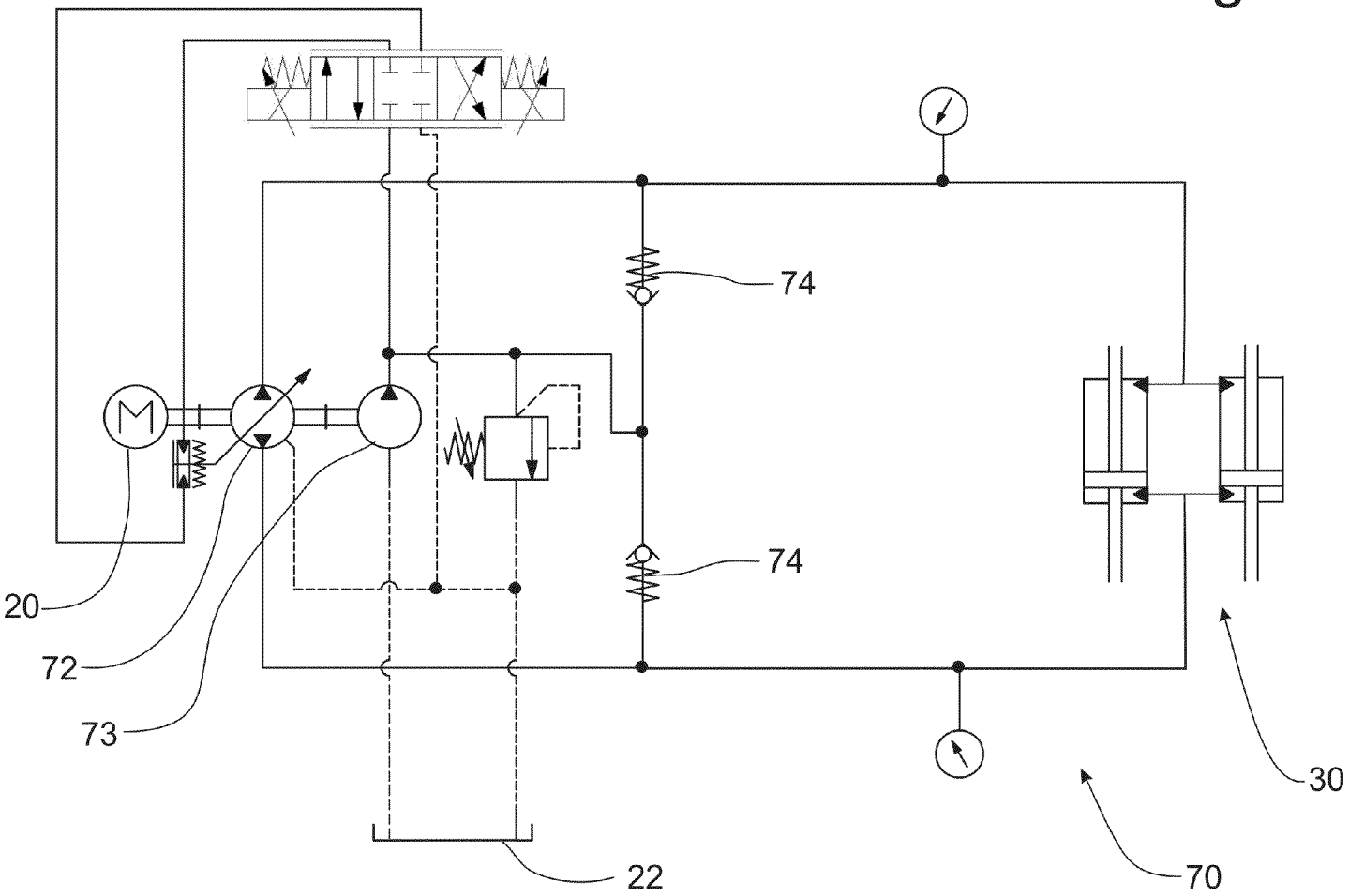
FIG. 8 is a schematic diagram of the closed loop hydraulic circuit providing hydraulic fluid under pressure to the hydraulic pump jack cylinder to affect reciprocal operation thereof.

Referring now to FIG. 8, one skilled in the art will recognize that the pump jack cylinder 30 is operatively connected to a closed loop hydraulic circuit 70, which includes a bi-directional, variable hydrostatic pump 72, with charge pressure, and having rotatable swash plate movable between forward and reverse orientations from a central neutral position. The hydrostatic pump 72 is preferably driven by an electric motor 20 in a single direction, but the rotatable swash plate enable the hydrostatic pump 72 to have the ability to pump oil either in the forward or the reverse direction. The time the hydrostatic pump 72 takes to rotate the swash plate from a full forward orientation to a full reverse orientation, or vice versa, is fixed, allowing for a computerized control of the operation of the hydrostatic pump 72, as will be described in greater detail below. Furthermore, the movement of the hydraulic fluid by the hydrostatic pump 72 enables the hydrostatic pump 72 to brake the movement of the sucker rod 15 and prevent free fall as the pump jack cylinders 30 begin the retraction stroke. The hydrostatic pump 72 is preferably driven by an electric motor 20, but can also be driven by a natural gas motor (not shown) or other suitable drive devices that provide a rotational input to the hydrostatic pump 72 in a predetermined direction.

The rotation of the swash plate in the hydrostatic pump 72 also provides for a smooth turnaround at the top and bottom of the stroke of the pump jack cylinder 30. Due to the nature of swash plate reversal in hydrostatic pumps to affect a change in direction of fluid flow, pumping efficiencies are increased. All conventional pumping units have a sinusoidal input to the sucker rod 15 at the top of the well. This sinusoidal input is due to a constant speed electric motor running the cross bar 25 through a pitman arm and a gearbox. The sucker rod 15 may be 5000-6000 feet long and is typically formed of high tensile strength material that has a tendency to operate much like a spring. With the conventional sinusoidal input, the sucker rod 15 can attain resonance, where the cross bar 25 is going up and down in a normal manner, but the other end of the sucker rod 15 is not moving at all, or is moving very little. The pump jack cylinder 15 and associated closed loop hydraulic circuit 70 provides a constant velocity for most of the cylinder up-stroke and then has a quick sinusoidal turnaround at the top of the stroke, followed by a constant velocity down-stroke with a quick sinusoidal turn-around at the bottom of the stroke. This mostly constant velocity motion with sinusoidal turn-arounds at the ends of the cylinder stroke tends to avoid the resonance situation that develops with a pure sinusoidal input.

The hydraulic fluid passing through the hydrostatic pump 72 within the closed loop hydraulic circuit 70 goes from the hydrostatic pump 72 to the pump jack cylinder 30 and then back to the other side of the hydrostatic pump 72. The hydraulic fluid in a closed loop hydraulic circuit 70 does not return to the reservoir 22, except for leakage. As with all closed loop hydraulic circuits, the closed loop hydraulic circuit 70 of the instant invention requires a charge flow. Thus, the closed loop hydraulic circuit 70 includes a charge pump 73 which has a flow capacity in the range of about 20% of the hydrostatic pump 72. Charge pressure is relatively low, usually in the 200-400 psi range.

Charge pressure and flow recharges the leakage in the hydraulic circuit 70 as some hydraulic fluid leaks out past the valve plates and piston bores, and past the swash plate within the hydrostatic pump 72. The charge flow also cools the hydraulic system and keeps the piston feet down on the swash plate in the hydrostatic pump 72. The charge pressure further provides servo-pressure to move the swash plate in the hydrostatic pump 72 into and out of stroke. The "low" or return side of the hydraulic circuit loop will always have charge pressure on it. The charge flow enters the hydraulic circuit loop through check valves 74 that isolate the charge circuit from the main circuit loop. Since the flow can be reversed, the charge flow enters the loop though which ever check valve 74 is adjacent to the low side of the hydraulic circuit loop at the time.

Figure 9:
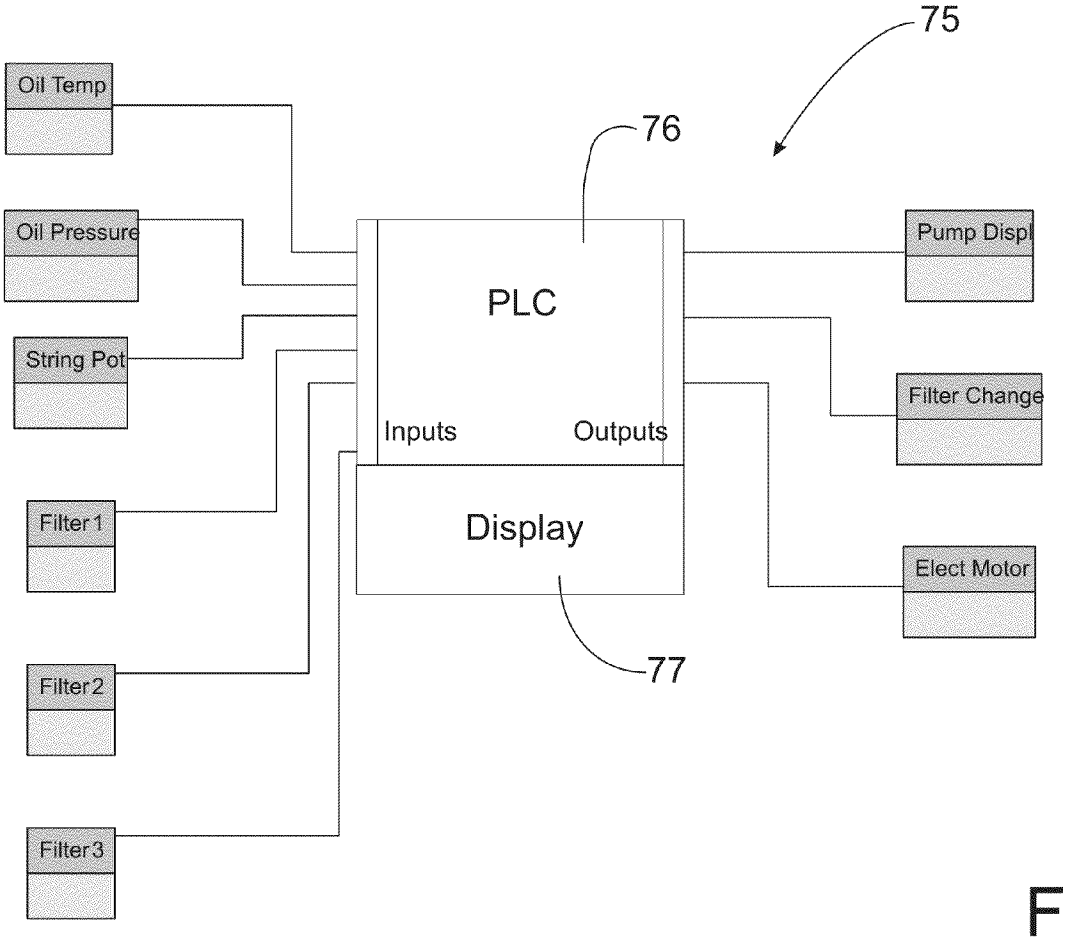
FIG. 9 is a schematic diagram of the programmable logic controller to control the operation of the closed loop hydraulic circuit in reciprocating the hydraulic pump jack cylinder.

Control of the operation of the closed loop hydraulic circuit 70 and the hydrostatic pump 72 is preferably accomplished through a programmable logic control system (PLC) 75, as is depicted in FIG. 9. The PLC consists of a PLC box 76 with the programmable logic control within it and a small color display 77 that also has a controller in it. The two controllers 76, 77 communicate on a CAN bus, which is also used for programming and diagnostics. The hydrostatic pump 72 has an Electronic Displacement Control, which is actuated with an electrical signal. A positive signal will make the pump jack cylinders 30 undergo an up-stroke, while reversing the polarity of the signal will make the pump jack cylinders 30 undergo a down-stroke. The total turn-around time, from full up-stroke to full down-stroke, is between 0.4 and 0.5 seconds.

When the operator starts the pump jack system 10, two parameters must be chosen, including the length of stroke in inches and the number of strokes per minute. Both the length of stroke and the number of strokes per minute figure into a calculation to determine the amount of stroke to ask the hydrostatic pump 72 to produce. This calculation directly correlates to the flow of hydraulic fluid the hydrostatic pump 72 must produce. For example, if the operator selects five strokes per minute with a stroke length of 84 inches, the hydrostatic pump 72 produces a given flow of hydraulic fluid to accomplish these parameters. However, if the stroke length is changed to 96 inches, the hydrostatic pump 72 will have to increase the flow because the hydrostatic pump 72 has to drive the piston rod 32 a longer distance over the same amount of chosen time. In addition, since the turn-around time at the ends of the up-stroke and down-stroke is fixed, the hydrostatic pump now needs to turn around sooner in order for the turn-around spot at the top (or bottom) of the stroke to remain the same.

Once the swash plate in the hydrostatic pump 72 moves to the requested up position, the flow of hydraulic fluid produced by the hydrostatic pump 72 is constant, and thus the speed of movement of the piston rod 32 is constant until the up-stroke nears the end of the stroke. Then, the PLC tells the swash plate to move to the down position and the sinusoidal turnaround occurs until the flow of hydraulic fluid stabilizes and the flow rate, as well as the speed of movement of the piston rod 32, is constant again. The PLC 75 needs an input to determine where the piston rods 32 are located at any given point in time during the operation of the pump jack cylinder 30. Such an input can be obtained from a string-pot, which extends and retracts with one of the pump jack cylinders 30 and is associated with some electronics so the PLC 75 can keep track of location of the piston rod 32. The PLC 75 then does the necessary calculations to give displacement amount and direction to the hydrostatic pump 72. Alternatively, a linear transducer, which has no moving parts except for a "magnetic" stick that slides by a sensor (not shown), can provide the positional input with respect to the location of the piston rod 32.

In addition to the PLC 75 controlling the operation of the hydrostatic pump 72, the PLC 75 receives inputs from several sensors to affect a shut down of the system 10 in the event certain parameters are exceeded. For example, the PLC 75 will undergo an emergency shutdown of the pump jack system 10 if the high pressure side of the closed loop hydraulic circuit 70 exceeds a predetermined parameter, or if the charge pressure on the low pressure side of the closed loop hydraulic circuit 70 is less than a predetermined parameter (which would provide an indication of a significant leak in the system 10); if the temperature of the hydraulic fluid exceeds a predetermined parameter; if the filters for the hydraulic fluid shut down; if the device for determining the location of the piston rod 32 ceases to function; or if the travel of the piston rod 32 does not match the command provided to the hydrostatic pump 72 by the PLC 75. In addition, the PLC 75 can activate a cooling fan if the temperature of the hydraulic fluid exceeds a predetermined parameter.

Preferably, the display 77 of the PLC 75 can output upon selection the temperature of the hydraulic fluid, the pressure of the high and low sides of the hydraulic circuit 70, the number of strokes per minute selected, the stroke length selected, the status of each of the filters within the hydraulic circuit 70, the number of hours of accumulated operation, and the total number of strokes undertaken by the system 10. Accordingly, the PLC 75 would receive inputs from the electric motor 20 as to whether the electric motor is started or stopped, a command from the operator to start or start the extension/retraction cycle of the pump jack cylinders 30, commands from the operator to set the desired number of strokes per minute and the desired stroke length, and a manual emergency shut down of the operation of the system 10.

One skilled in art will understand that manufacturing tolerances in the construction of the hydraulic pump jack cylinder 30 will result in the formation of the pump jack cylinder 30 with the cylinder ratio not exactly at a 1:1 ratio. In other words, the cross-sectional area at the end of the inner piston shaft 35 is not exactly equal to the cross-sectional area of the cavity 45 against which the hydraulic fluid from the port 60 acts to retract the piston rod 32. One skilled in the art will recognize that every hydrostatic pump has a small amount of leakage around the valve plate and some fluid blow-by past the piston. In addition, the hydraulic cylinders 30 will have some leakage past the seals 36, 42 during operation. Such leakages tend to balance themselves out, but not always.

If the cylinder ratio is unbalanced too much, the result will be that the high side pressure in the closed loop hydraulic circuit 70 will become elevated, representing the condition that the oil is flowing into the side with the smaller (unbalanced) area. The hydrostatic pump 72 is capable of accommodating some unbalances as such unbalances are anticipated by normal leakages. It is believed that the cylinder ration needs to be within about 1.5% to provide a nominally equal cylinder ratio and avoid operational trouble. This percentage roughly correlates to a volumetric efficiency of a hydrostatic piston pump being in the 97-98% range, which is within the ability of the hydrostatic pump to accommodate. In general, except for the danger of high-pressuring the loop, an unbalanced cylinder ratio in the 1.5% range is not enough to cause problems. The error corresponding to such an unbalance per each nine second cycle is only on the order of 0.1 second. Since the PLC 75 watches the location of the piston rod 32 with the string-pot or linear transducer to see where the piston rod 32 is located, the PLC 75 provides the command to the hydrostatic pump 72 to turn around anyway.

It will be understood that changes in the details, materials, steps and arrangements of parts, which have been described and illustrated to explain the nature of the invention will occur to and may be made by those skilled in the art upon a reading of this disclosure within the principles of the scope of the invention. For example, the cross bar 25 can be pivoted from a frame support with one end of the cross bar connected to the sucker rod 15 and the opposing end connected to the piston rod 32 of a single pump jack cylinder 30. The foregoing description illustrates the preferred embodiment of the invention; however, concepts, as based upon the description may be employed in other embodiments without departing from the scope of the invention. Accordingly, the following claims are intended to protect the invention broadly, as well as in the specific form shown.

Having thus described the invention, what is claimed is:

1. A pump jack system for reciprocating a pump rod within a well comprising:

a cross bar connected to said pump rod at a central portion thereof and mounted for movement to cause said pump rod to move vertically;

a pair of hydraulic pump jack cylinders having a nominal cylinder ratio of 1:1, said pump jack cylinders including a piston rod connected to said cross bar on opposing sides of said pump rod to affect movement of the cross bar vertically and induce vertical movement of the pump rod, each said hydraulic pump jack cylinder including:

an outer piston shaft forming said piston rod, said outer piston shaft being movable within an outer piston tube, said outer piston shaft being spaced internally of said outer piston tube to define a cavity therebetween, said cavity having a first cross-sectional area; and an inner piston shaft movable within an inner piston tube, said inner piston tube being positioned within said outer piston tube, said inner piston shaft having a second cross-sectional area nominally equal to said first cross-sectional area; and a closed loop hydraulic circuit connected to said hydraulic pump jack cylinder to provide a flow of hydraulic fluid under pressure to said hydraulic pump jack cylinder to cause extension and retraction of said piston rod, said closed loop hydraulic circuit including a hydrostatic pump controlling the flow of hydraulic fluid to said hydraulic pump jack cylinders in forward and reverse directions.

2. The pump jack system of claim 1 wherein said hydraulic pump jack cylinder further comprises a cylinder housing surrounding said outer piston tube and defining an annular fluid passageway between said cylinder housing and said outer piston tube.

3. The pump jack system of claim 2 further comprising a cylinder casing surrounding said cylinder housing and defining a casing cavity therebetween, said casing cavity containing a supply of hydraulic fluid under pressure due to connection of said casing housing to a container of pressurized inert gas.

4. The pump jack system of claim 3 wherein said hydraulic pump jack cylinder further comprises a cylinder base cap mounting said inner and outer piston tubes, said cylinder base cap being mounted on a centering pin supported from said cylinder casing, said cylinder base cap including a cross hole interconnecting said annular fluid passageway and a pocket beneath said inner piston shaft.

5. The pump jack system of claim 2 wherein said hydraulic pump jack cylinder includes a first port and a second port for connection to said closed loop hydraulic circuit to receive hydraulic fluid under pressure therefrom, said first port being in flow communication with said annular fluid passageway, said second port being in flow communication with said cavity between said outer piston shaft and said outer piston tube.

6. The pump jack system of claim 1 wherein said inner and outer piston shafts respectively carry seals for engaging the corresponding inner and outer piston tubes to prevent the passage of hydraulic fluid past said seals, said inner piston shaft and the seal thereon projecting outwardly of said outer piston shaft and the seal carried thereon to facilitate access to both seals when said piston rod is removed from said outer piston tube for servicing.

7. A hydraulic pump jack cylinder for reciprocating a pump rod within a well comprising:

an outer piston shaft forming a piston rod, said outer piston shaft being movable within an outer piston tube, said outer piston shaft being spaced internally of said outer piston tube to define a cavity therebetween, said cavity having a first cross-sectional area;

an inner piston shaft movable within an inner piston tube, said inner piston tube being positioned within said outer piston tube, said inner piston shaft having a second cross-sectional area nominally equal to said first cross-sectional area; and a cylinder housing surrounding said outer piston tube and defining an annular fluid passageway between said cylinder housing and said outer piston tube.

8. The hydraulic pump jack cylinder of claim 7 wherein said hydraulic pump jack cylinder further comprises a cylinder base cap mounting said inner and outer piston tubes, said cylinder base cap including a cross hole interconnecting said annular fluid passageway and a pocket beneath said inner piston shaft.

9. The hydraulic pump jack cylinder of claim 8 further comprising a cylinder casing surrounding said cylinder housing and defining a casing cavity therebetween, said casing cavity containing a supply of hydraulic fluid under pressure due to connection of said casing housing to a container of pressurized inert gas.

10. The hydraulic pump jack cylinder of claim 9 wherein said cylinder base cap is mounted on a centering pin supported from said cylinder casing.

11. The hydraulic pump jack cylinder of claim 8 wherein said hydraulic pump jack cylinder is operatively connected to a closed loop hydraulic circuit having a hydrostatic pump supplying a flow of hydraulic fluid under pressure to said hydraulic pump jack cylinder.

12. The hydraulic pump jack cylinder of claim 11 wherein said hydraulic pump jack cylinder further includes a first port and a second port for connection to said closed loop hydraulic circuit to receive hydraulic fluid therefrom, said first port being in flow communication with said annular fluid passageway, said second port being in flow communication with said cavity between said outer piston shaft and said outer piston tube.

13. The hydraulic pump jack cylinder of claim 7 wherein said inner and outer piston shafts respectively carry seals for engaging the corresponding inner and outer piston tubes to prevent the passage of hydraulic fluid past said seals, said inner piston shaft and the seal thereon projecting outwardly of said outer piston shaft and the seal carried thereon to facilitate access to both seals when said piston rod is removed from said outer piston tube for servicing.

14. A hydraulic pump jack system for reciprocating a pump rod within a well comprising:

a cross bar connected at a central portion to said pump rod and being mounted for movement to cause said pump rod to move vertically;

a pair of hydraulic pump jack cylinders connected to said cross bar on opposing sides of said pump rod to move said cross bar vertically to induce movement of said pump rod vertically, each said hydraulic pump jack cylinder including piston rod connected to said cross bar to affect movement of the cross bar corresponding to vertical movement of the pump rod, said piston rod having a nominal cylinder ratio of 1:1, each said pump jack cylinder having:

an outer piston shaft forming said piston rod, said outer piston shaft being movable within an outer piston tube, said outer piston shaft being spaced internally of said outer piston tube to define a cavity therebetween, said cavity having a first cross-sectional area;

an inner piston shaft movable within an inner piston tube, said inner piston tube being positioned within said outer piston tube, said inner piston shaft having a second cross-sectional area nominally equal to said first cross-sectional area; and a cylinder housing surrounding said outer piston tube and defining an annular fluid passageway between said cylinder housing and said outer piston tube; and a closed loop hydraulic circuit including a hydrostatic pump connected to said hydraulic pump jack cylinder to provide a flow of hydraulic fluid under pressure to said hydraulic pump jack cylinder to cause extension and retraction of said piston rod, said closed loop hydraulic circuit.

15. The hydraulic pump jack system of claim 14 wherein said hydraulic pump jack cylinder further comprises a cylinder base cap mounting said inner and outer piston tubes, said cylinder base cap including a cross hole interconnecting said annular fluid passageway and a pocket beneath said inner piston shaft.

16. The hydraulic pump jack system of claim 15 further comprising a cylinder casing surrounding said cylinder housing and defining a casing cavity therebetween, said cylinder base cap being mounted on a centering pin supported from said cylinder casing.

17. The hydraulic pump jack system of claim 16 wherein said inner and outer piston shafts respectively carry seals for engaging the corresponding inner and outer piston tubes to prevent the passage of hydraulic fluid past said seals, said inner piston shaft and the seal thereon projecting outwardly of said outer piston shaft and the seal carried thereon to facilitate access to both seals when said piston rod is removed from said outer piston tube for servicing.

* * * * *